US008662658B2

(12) United States Patent
Kerxhalli et al.

(10) Patent No.: US 8,662,658 B2
(45) Date of Patent: Mar. 4, 2014

(54) PRINTER HAVING DRUM MAINTENANCE UNIT ARCHITECTURE FOR CONTROLLED APPLICATION OF A RELEASE AGENT

(75) Inventors: David M. Kerxhalli, Rochester, NY (US); David A. VanKouwenberg, Avon, NY (US); Jonathan B. Hunter, Marion, NY (US); Norman D. Robinson, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/404,658

(22) Filed: Feb. 24, 2012

(65) Prior Publication Data

US 2013/0222466 A1 Aug. 29, 2013

(51) Int. Cl.
*B41J 2/01* (2006.01)

(52) U.S. Cl.
USPC ..... 347/103

(58) Field of Classification Search
USPC ..... 347/101, 103, 5, 100; 399/273, 274, 399/284, 260, 346
See application file for complete search history.

(56) References Cited

U.S. PATENT DOCUMENTS 5,430,527 A * 7/1995 Maruyama et al. ..... 399/176
5,450,185 A * 9/1995 Kuribayashi et al. ..... 399/350
5,790,160 A * 8/1998 Reeves et al. ..... 347/103
6,102,523 A * 8/2000 Desie et al. ..... 347/55
6,494,570 B1 * 12/2002 Snyder ..... 347/103
6,921,064 B2 * 7/2005 Rousseau ..... 267/36.1
7,810,897 B2 * 10/2010 Tanaka et al. ..... 347/21
2005/0110856 A1 * 5/2005 Mouri et al. ..... 347/103
2005/0191099 A1 * 9/2005 Yamaguchi et al. ..... 399/346
2007/0071525 A1 * 3/2007 Yoshino et al. ..... 399/346
2007/0127960 A1 * 6/2007 Yoshida ..... 399/346
2007/0139496 A1 * 6/2007 Leighton et al. ..... 347/88
2009/0185843 A1 * 7/2009 Chiba et al. ..... 399/348
2010/0215417 A1 * 8/2010 Fujimori ..... 399/346
2012/0134725 A1 * 5/2012 Kawahara et al. ..... 399/346

* cited by examiner

*Primary Examiner* — Matthew Luu
*Assistant Examiner* — Patrick King
(74) *Attorney, Agent, or Firm* — Maginot, Moore & Beck, LLP

(57) ABSTRACT

An inkjet offset printer includes at least one printhead to eject ink on a release agent applied to an image receiving member for subsequent transfer of the ink to the surface of a recording media. The release agent is applied to the image receiving member by at least two release agent applicators. The release agent can be selectively applied to process sheets of recording media of different sizes to improve print quality. Selective application of release agent to the image receiving member prevents release agent from migrating to a transfix roll, and subsequently to the back side of the media which affects the image quality.

9 Claims, 4 Drawing Sheets

PRINTER HAVING DRUM MAINTENANCE UNIT ARCHITECTURE FOR CONTROLLED APPLICATION OF A RELEASE AGENT

TECHNICAL FIELD

This disclosure relates generally to solid ink offset printers, and more particularly to the controlled application of a release agent to a rotating image receiving member to achieve improved image quality.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the surface of an image receiving member, which can be a rotating print drum or endless belt. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band. Recording media are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process.

Offset phase change inkjet printers utilize drum maintenance units (DMUs) to facilitate the transfer of ink images to the recording media. A DMU is usually equipped with a reservoir that contains a fixed supply of release agent (e.g., silicone oil), and an applicator for delivering the release agent from the reservoir to the surface of the rotating member. One or more elastomeric metering blades are also used to meter the release agent onto the transfer surface at a desired thickness and to divert excess release agent and un-transferred ink pixels to a reclaim area of the drum maintenance system. The collected release agent is filtered and returned to the reservoir for reuse.

During transfer of the ink images from the image receiving member to the recording media, the recording media extracts a small quantity of release agent from the surface of the image receiving member. The ink pixels that are placed on the oiled and metered imaging surface typically remove more oil from the imaging surface during transfer than the non-inked media does. This difference in oil removal produces a differential oil "ghost" of the image that resides on the image receiving member until the next drum maintenance cycle. This oil "ghost" is erased by the subsequent flooding of oil on the imaging member by the oil applicator and the metering of the release agent layer by the elastomeric blade. Additionally, since some ink drops in an ink image often fail to transfer to the recording media, the image receiving member carries some residual ink drops that can transfer to a subsequent recording media resulting in a "freckling" effect on the subsequent recording media. To reduce or prevent ghosting and freckling, the DMU applies a new coating of release agent to the image receiving member after each image formation and transfer operation from the image receiving member. The metering blade removes residual ink drops from the image receiving member and forms a layer of release agent with uniform thickness on the image receiving member. Frequent use of the DMU reduces the operational life of the DMU, but is necessary in existing printers to avoid excessive ghosting and freckling.

Indirect inkjet printers are capable of producing either simplex or duplex prints. Simplex printing refers to production of an image on only one side of a print media. Duplex printing produces an image on each side of a media sheet. In duplex indirect printing, an ink image is initially formed on an intermediate drum and then transferred to the media. The media sheet is then inverted and sent along a path that passes the second side of the media sheet by the intermediate drum upon which the ink has been deposited for the formation of a second ink image on the second side.

In indirect printing systems, significant levels of oil on the media before imaging is undesirable since the release agent can prevent ink from properly adhering or transferring to the media. Therefore, preventing the release agent from transferring to the back side of a sheet during printing of the first side image is desirable. Current printing systems must slow down and use special sequencing in duplex mode to prevent release agent from being transferred to the back of a sheet during front side printing. In an indirect printer, if the transfix roller and intermediate member also contact one another before a media sheet reaches the transfix nip or between sheets as they pass through the nip and release agent transfers to the transfix roller from the intermediate member.

For duplex prints, the excessive release agent transferred to the second side of the media sheet can interfere with the printing of ink images on the second side of the media sheet. In an indirect printing system, the presence of release agent on the media can result in some ink remaining on the intermediate member instead of transferring to the media. In both cases, the loss of ink produces an image having partial or missing pixels. When the partial or missing pixels are detectable by the human eye the phenomenon is known as image dropout.

In some areas on the surface of the drum where no recording media is placed, the drum can contact the transfix roll and oil can be transferred from the drum to the transfix roll. This oil can then be placed on the backside of subsequent sheets of recording media transported by the drum if printing in a duplex mode, where the backside recording media receives an image after the frontside of the recording media. If oil has been place on the backside of the sheet before printing, the transfer of the image to the backside of the sheet can be of poor quality, causing an image quality defect. The presence of release agent can be a problem especially in the "interpanel" zones or spaces between the second end of one sheet and the first end of a second sheet being sequentially printed. The improper deposit of oil on a recording sheet can also occur where print jobs are made with mixed paper sizes, especially in the cross-process direction. Thus, improvements to printers to reduce or eliminate the application of or amount of release agent to unwanted areas of the imaging drum and the transfix roller during printing are desirable.

SUMMARY

A printer includes first and second release agent applicators to selectively apply a release agent to an intermediate image receiving drum prior to an ink being applied to the release agent. The printer is adapted to form an ink image on recording media of different sizes ranging from a first size to a second size larger than the first size. The printer includes an image receiving member having a surface and a printhead disposed adjacent to the image receiving member to form an ink image on the surface. A first release agent applicator is disposed adjacent to the image receiving member and is configured to deposit a release agent at a first area on the surface of the image receiving member. A second release agent applicator is disposed adjacent to the image receiving member and is configured to deposit a release agent at a second area on the surface of the image receiving member, where at least a portion of the second area is not within the first area. A first metering blade is configured to move the release agent about at least one of the first area and the second area of the surface of the image receiving member.

A method for indirect printing includes selectively applying a release agent to a surface of an image receiving member to match the size of recording media to reduce image defects. The method applies a release agent to the surface of an image receiving member adapted to fix an image on a first sheet and a second sheet of recording media transported sequentially by the image receiving member. The method includes determining a first area to be covered by the first sheet on the image receiving member when being transported by the image receiving member, applying release agent to a first portion of the first area to be covered by the first sheet with a first release agent applicator, applying release agent to a second portion of the first area to be covered by the first sheet with a second release agent applicator, and spreading the release agent applied to the first portion and to the second portion of the first area.

BRIEF DESCRIPTION OF THE DRAWINGS

The foregoing aspects and other features of a printer including a drum maintenance unit are explained in the following description, taken in connection with the accompanying drawings.

DETAILED DESCRIPTION

Figure 1:
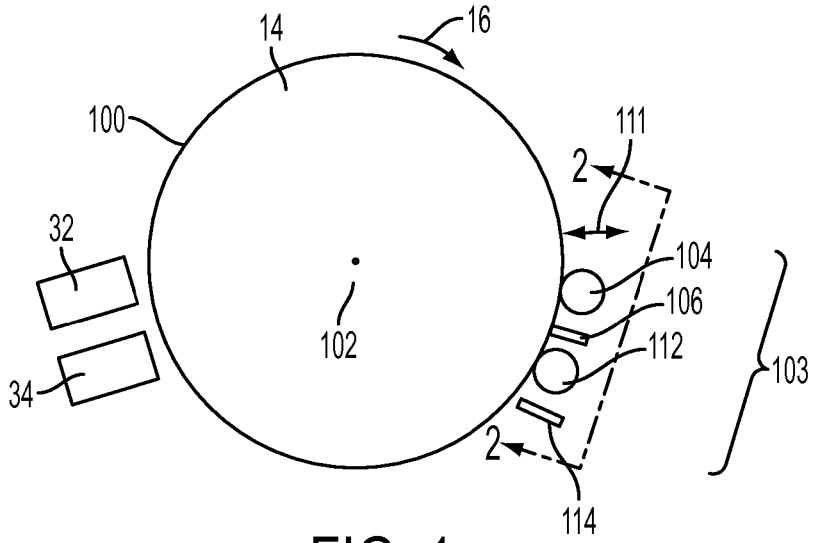
FIG. 1 is a schematic side elevational view of a plurality of printhead modules and a plurality of maintenance units positioned adjacent to an image receiving member.

For a general understanding of the environment for the system and method disclosed herein as well as the details for the system and method, reference is made to the drawings. In the drawings, like reference numerals have been used throughout to designate like elements. As used herein the term "printer" refers to any device that produces ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper.

Figure 5:
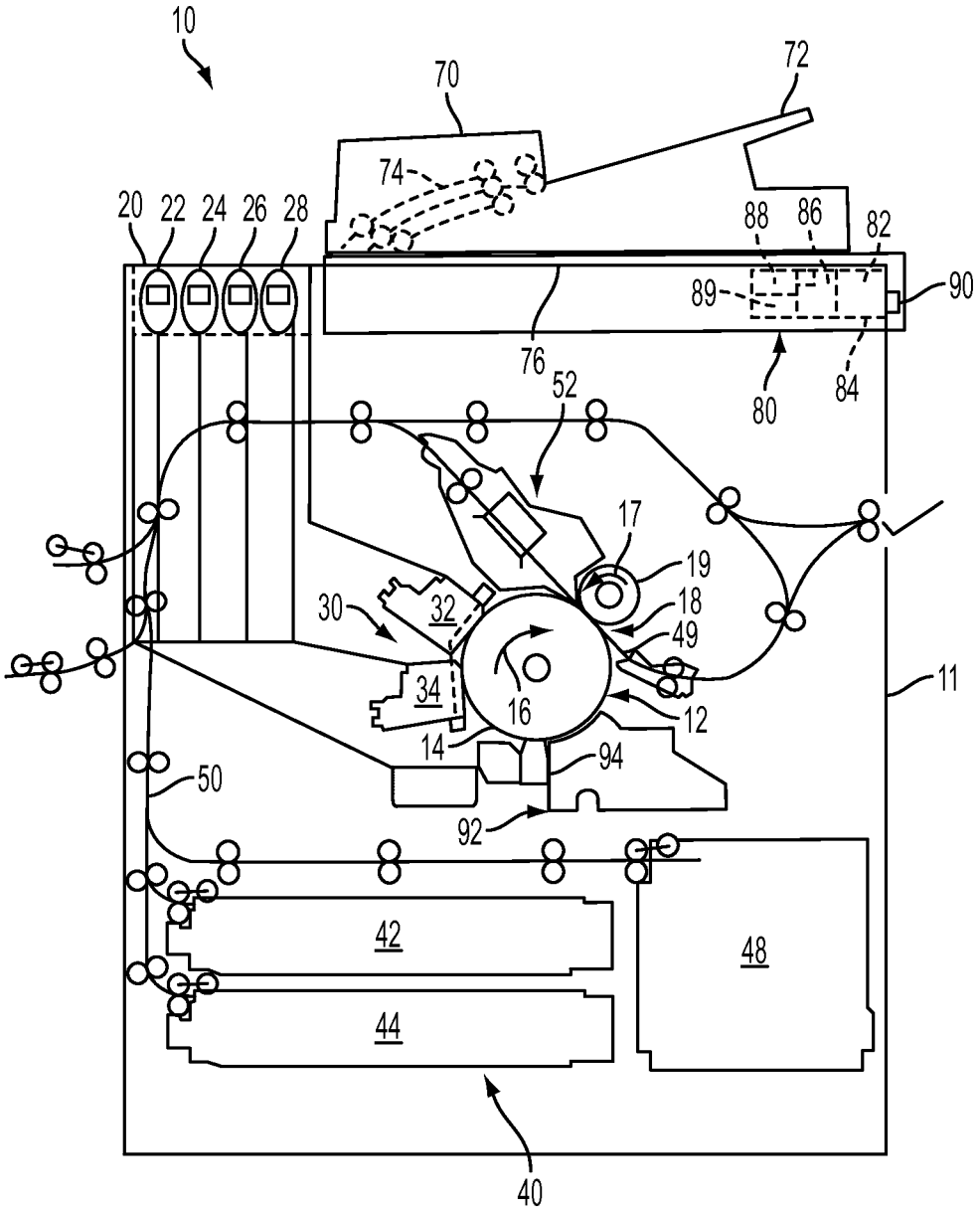
FIG. 5 PRIOR ART
FIG. 5 is a schematic view of an inkjet printer configured to print images onto a rotating image receiving member and to transfer the images to recording media.

FIG. 5 illustrates a prior art high-speed phase change ink image producing machine or printer 10. As illustrated, the printer 10 includes a frame 11 supporting directly or indirectly operating subsystems and components, as described below. The printer 10 includes an image receiving member 12 that is shown in the form of a drum, but can also include a supported endless belt. The image receiving member 12 has an imaging surface 14 that is movable in a direction 16, and on which phase change ink images are formed. A transfix roller 19 rotatable in the direction 17 is loaded against the surface 14 of drum 12 to form a transfix nip 18, within which ink images formed on the surface 14 are transfixed onto a recording media 49, such as heated media sheet.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or any number greater than two.

As further shown, the phase change ink printer 10 includes a recording media supply and handling system 40, also known as a media transport. The recording media supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The recording media supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the processes, described more fully below, that enable the printer to perform the DMU cycles selectively. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Additionally, pixel placement control is exercised relative to the imaging surface 14 thus forming desired images per such image data, and receiving substrates, which can be in the form of media sheets 49, are supplied by any one of the sources 42, 44, 48 and handled by recording media system 50 in timed registration with image formation on the surface 14. Finally, the image is transferred from the surface 14 and fixedly fused to the image substrate within the transfix nip 18.

In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). When images are deposited on the image receiving member 12 according to the multi-pass method, under control of the controller 80, a portion of the image is deposited by the printheads within the printhead assemblies 32, 34 during a first rotation of the image receiving member 12. Then during one or more subsequent rotations of the image receiving member 12, under control of the controller 80, the printheads deposit the remaining portions of the image above or adjacent to the first portion printed. Thus, the complete image is printed one portion at a time above or adjacent to each other during each rotation of the image receiving member 12. For example, one type of a multi-pass printing architecture is used to accumulate images from multiple color separations. On each rotation of the image receiving member 12, ink droplets for one of the color separations are ejected from the printheads and deposited on the surface of the image receiving member 12 until the last color separation is deposited to complete the image. In some cases, for example cases in which secondary or tertiary colors are used, one ink droplet or pixel can be placed on top of another one, as in a stack. Another type of multi-pass printing architecture is used to accumulate images from multiple swaths of ink droplets ejected from the print heads. On each rotation of the image receiving member 12, ink droplets for one of the swaths (each containing a combination of all of the colors) are applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording medium.

In a multi-pitch printing architecture, the surface of the image receiving member is partitioned into multiple segments, each segment including a full page image (i.e., a single pitch) and an interpanel zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image or images have been printed on the image receiving member 12 under control of the controller 80 in accordance with an imaging method, such as the single pass method or the multi-pass method, the exemplary inkjet printer 10 converts to a process for transferring and fixing the image or images at the transfix roller 19 from the image receiving member 12 onto a recording medium 49. According to this process, a sheet of recording medium 49 is transported by a transport under control of the controller 80 to a position adjacent the transfix roller 19 and then through a nip formed between the movable or positionable transfix roller 19 and image receiving member 12. The transfix roller 19 applies pressure against the back side of the recording medium 49 in order to press the front side of the recording medium 49 against the image receiving member 12. Although the transfix roller 19 can also be heated, in this exemplary embodiment, it is not. Instead, a pre-heater for the recording medium 49 is provided in the media path leading to the nip. The pre-heater provides the necessary heat to the recording medium 49 for subsequent aid in transfixing the image thereto, thus simplifying the design of the transfix roller. The pressure produced by the transfix roller 19 on the back side of the heated recording medium 49 facilitates the transfixing (transfer and fusing) of the image from the image receiving member 12 onto the recording medium 49.

The rotation or rolling of both the image receiving member 12 and transfix roller 19 not only transfixes the images onto the recording medium 49, but also assists in transporting the recording medium 49 through the nip formed between them. Once an image is transferred from the image receiving member 12 and transfixed to a recording medium 49, the transfix roller 19 is moved away from the image receiving member 12. The image receiving member 12 continues to rotate and, under the control of the controller 80, any residual ink left on the image receiving member 12 is removed by drum maintenance procedures performed at a drum maintenance unit (DMU) 92.

The DMU 92 can include a release agent applicator 94, a metering blade, and, in some embodiments, a cleaning blade. The release agent applicator 94 can further include a reservoir having a fixed volume of release agent such as, for example, silicone oil, and a resilient donor roll, which can be smooth or porous and is rotatably mounted in the reservoir for contact with the release agent and the metering blade. The metering blade is compliant such that it can firmly and uniformly contact the image receiving member. The cleaning blade is also compliant such that it can firmly and uniformly contact the image transfer surface. The DMU 92 is operably connected to the controller 80 such that the donor roll, metering blade and cleaning blade are selectively moved by the controller 80 into temporary contact with the rotating image receiving member 12 to deposit and distribute release agent onto and remove un-transferred ink pixels from the surface of the member 12.

The primary function of the release agent is to prevent the ink from adhering to the image receiving member 12 during transfixing when the ink is being transferred to the recording medium 49. The release agent also aids in the protection of the transfix roller 19. Small amounts of the release agent are transferred to the transfix roller 19 and this small amount of release agent helps prevent ink from adhering to the transfix roller 19. Consequently, a minimal amount of release agent on the transfix roller 19 is acceptable.

To manage the application and distribution of the release agent on the image receiving member and the recording media, the controller 80 can periodically operate the DMU 92 to perform a DMU cycle. A DMU cycle is comprised of multiple functions including applying a uniform layer of release agent, cleaning un-transferred pixels from the previous image off of the image transfer surface, and eliminating differential glosses in the amount of release agent remaining on the image member following the printing of an image.

The image receiving member 12 has a tightly controlled surface that provides a microscopic reservoir capacity to hold the release agent. Too little release agent present in areas or over the entire image receiving member prevents transfer of the ink pixels to the recording media 49. This image defect is referred to herein as "image dropout" when it occurs over particular areas or pixels of the ink image and "cohesive image transfer failure" when it occurs over the entirety of the ink image. Conversely, too much release agent present on the image receiving member 12 results in transfer of some release agent to the back side of the recording media 49. If the recording media 49 is then printed on both sides in duplex printing, the ink pixels may not adhere properly to the second side of the recording media 49. To combat these image defects, each DMU cycle selectively applies and meters release agent onto the surface of the image receiving member 12 by bringing the donor roller and then the metering blade of the release agent applicator 94 into contact with the surface of the image receiving member 12 prior to subsequent printing of images on the image receiving member 12 by the printheads in assemblies 32, 34. These actions replenish the release agent to the reservoir on the surface of the image receiving member 12 to prevent image failure and ensure continued application of a uniform layer of release agent to the surface of the image receiving member 12.

To clean un-transferred pixels or image dropouts from the previous image off the image receiving member surface 14, the controller 80 brings the metering and/or cleaning blade into contact with the image receiving member 12 following the printing of an image. If these dropout pixels are not removed by the DMU 92 they are typically transfixed onto the next image that is printed. These pixels can produce image defects, especially when the stray pixel is transfixed onto a field of high coverage yellow or white space. This defect, or "freckling", is an image dropout that was not collected by the DMU 92.

As images are printed, the recording media 49 and the ink remove release agent from the surface of the image receiving member 12, but typically in uneven amounts over the surface of the image receiving member 12. The evenness of the amount of release agent removed from the surface of the image receiving member 12 depends on, among other factors, the smoothness of the recording media 49 and the density of the pixel placement in the print image. After an image is transfixed, the surface of the image receiving member 12 can be left with a pattern of differential release agent placement that is the inverse of the release agent removed by the ink pixels and recording media 49 of the previous image. If left uncorrected, the residual release agent, or "ghosting", can appear within inked regions of the next media sheet 49. To prevent ghosting, the DMU cycle corrects the amount of release agent applied over the image receiving member 12 to reduce differentials in the amount of release agent remaining on the image receiving member following the printing of an image.

Figure 2:
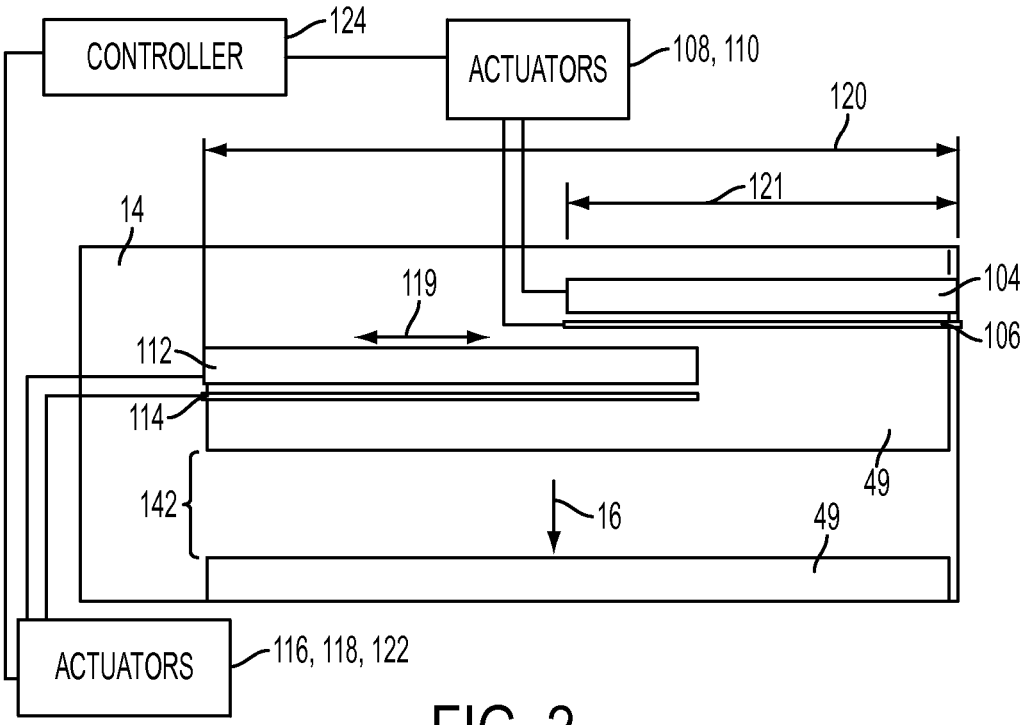
FIG. 2 is a schematic plan view of first and second release agent applicators and metering blades positioned adjacent a surface of an image receiving member of FIG. 1 taken along line 2-2.

Referring now to FIG. 1 and to FIG. 2, the image receiving member 14 is shown with printhead assemblies 32 and 34 disposed adjacent to a surface 100 of the image receiving member 14, which is depicted as a rotating drum in the figure. The image receiving member 14 rotates in the process direction 16 about an axis 102. Disposed adjacent to the surface 100 is one embodiment of a drum maintenance unit 103 including a first release agent applicator 104, also known as the donor roll, and a first metering blade 106. The applicator 104 and the blade 106 cooperate to apply the release agent provided by a reservoir (not shown). The first release agent applicator 104 is coupled to an actuator 108 and the first metering blade 106 is coupled to an actuator 110 (FIG. 2) with each actuator being configured to position or to move the first release agent applicator 104 and the first metering blade 106 into and out of engagement with the surface 100 of the image receiving member 14 in the direction 111. The first and second actuators 108 and 110 can be operatively connected to a single member, which is configured to move both the first release agent applicator 104 and the first metering blade 106 at substantially the same time. In other embodiments, separate actuators can be configured to move the applicator 104 and the blade 106 either substantially at the same time or at different times.

The drum maintenance unit 103 further includes a second release agent applicator 112 and a second metering blade 114. The applicator 112 and the blade 114 cooperate to apply the release agent from a release agent supply reservoir to the surface 100 of the drum 14. An actuator 116 is coupled to the second release agent applicator 112 and an actuator 118 is coupled to the second metering blade 114 (FIG. 2). The actuators 116 and 118 move the second release agent applicator 112 and the second metering blade 114, respectively, into and out of engagement with the surface 100 of the drum 14. While a first set of applicator/metering blade and a second set of applicator/metering blade mechanisms are shown, additional sets of applicator/metering blade mechanisms can be provided. Actuators 116 and 118 can move the respective applicators either substantially simultaneously or at different times. The applicators 104 and 112 can be constructed of known fluid absorbing materials, including polyurethane foam or the like.

The ink image is formed on top of the release agent layer. The image is then transferred to the sheet of recording media 49 while being transported in the nip between the drum 14 and the pressure roll 19. The oil deposited on the drum 14 assists in releasing the image, which was deposited on the drum 14 by the printheads 32 and 34, from the drum 14 in order to achieve efficient transfer of the image to the recording media. By using the two separate release agent applicators 104 and 112 and the two separate metering blades 110 and 114, improved print quality can be provided for phase change inkjet printers.

In one embodiment, as illustrated in FIG. 2, an edge registered system includes a first applicator/metering blade mechanism including the applicator roll 104 and metering blade 106, each of which is fixed along a longitudinal axis defined by the axis of rotation 102 of the image receiving member 14 of FIG. 1. This axis also defines what is known as a cross-process length 120 of a recording media being transported in the process direction 16. The cross-process length 120, as illustrated, also represents the cross-process length of the largest sheet of recording media being printed. A width 121 of the applicator 104 and the metering blade 106 can be selected to be substantially the same as the width of the smallest recording media upon which ink is to be placed. The second applicator/metering blade combination including the applicator 112 and the metering blade 114 can be moved or offset in the direction 119 with respect to the first applicator/metering blade combination 104/106 and positioned in the cross-process direction 120 through the use of an actuator 122.

While the actuators 116 and 118, as described above, provide for movement of the applicator 112 and the metering blade 114 into and out of engagement with the surface 100 of the image receiving member 14, the embodiment of FIG. 2 includes an additional actuator 122, which is adapted to move the applicator 112 and the blade 114 along the longitudinal axis of the drum 14. By controlling the cross-process position 120 of the applicator 112 and of the blade 114, a cross-process distance on the surface 100 of the drum 14 corresponding to the cross-process size of a recording medium can be covered appropriately with release agent. In addition, by controlling the timing of engagement and disengagement of the applicator with respect to the drum 14 using the actuators 108, 110, 116, and 118, the total process distance for applying the release agent can match the area coverage of a recording media corresponding to the process distance and the cross-process distance of the recording media. A controller 124 coupled to the actuators 108, 110, 116, 118, and 122 can be programmed appropriately to determine the sequence of positioning required for the application of the proper amount of release agent needed to cover the surface 100 of the drum 14 for different sizes of recording media. In some embodiments, the controller 124 is incorporated into the controller 80 of the printer 10 of FIG. 5.

Figure 3:
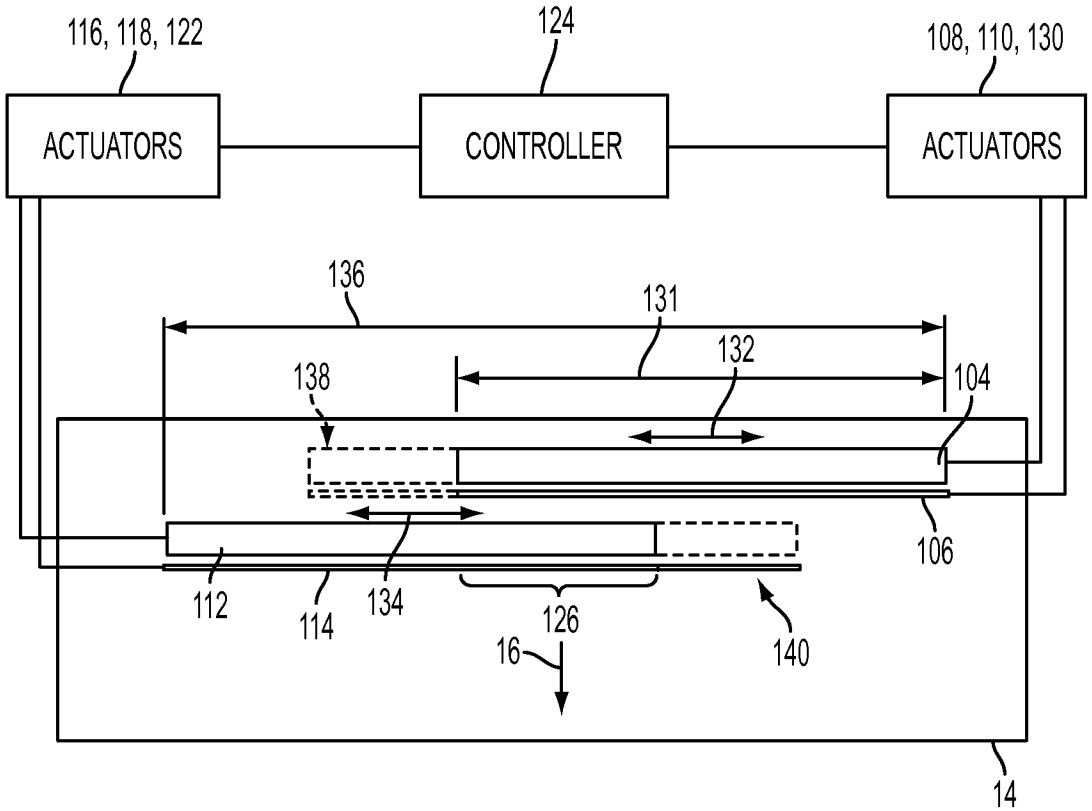
FIG. 3 is a schematic plan view of another embodiment of first and second release agent applicators and metering blades positioned adjacent a surface of an image receiving member.

FIG. 3 illustrates another embodiment of a release agent applicator system including a center registered configuration in which the process direction line 16 also illustrates a centerline of the drum 14. In this embodiment, the first and second release agent applicators 104 and 112 and first and second metering blades 106 and 114 are initially positioned at a longitudinal center portion of the surface 100 of the drum 14 generally shown in FIG. 3 as line 16. In this embodiment, the end of the first applicator/blade combination 104/106 overlaps the end of second applicator/blade combination 112/114 along a central portion 126 of the drum 14. At least one of the application/metering blade combinations includes a length in the cross-process direction substantially equal to the smallest cross-process distance of the recording media processed by the printer.

While each of the first and second application/metering blade combinations can be positioned to engage and disengage the surface 100 of the drum 14 as previously described, each of the applicator/metering blade combinations of FIG. 3 can be moved longitudinally along the surface of the drum 14 in the cross-process direction before engagement with the surface of the drum. This embodiment allows for precise release agent application on the drum so release agent can be applied to areas of the drum that support the media. In this center registered system, both sets of oil applicator/metering blade combinations translate from the center toward opposite outer edges of the drum 14 to match the cross-process recording media size. Even where the release agent applicators overlap in an area when applying the release agent, a correct amount of release agent is applied since the trailing metering blade meters the release agent to the correct level.

As illustrated in FIG. 3, the applicator 104 and the blade 106 are coupled to an actuator 130, which provides for translational movement of the applicator and the blade in the cross process direction. In this embodiment, neither of the applicator/blade combinations lacks a mechanism enabling movement along the longitudinal axis. Consequently, the applicator/blade combination 104/106 is not fixed as illustrated in FIG. 2. In addition, at least one of the applicator/blade combinations includes a cross-process length 131 sufficient to cover a portion of the surface of the drum 14 corresponding to the smallest cross-process size of recording media accommodated by the printer. Each of the applicator/blade combinations also can also move away from the centerline towards an edge of the drum in respective directions 132 and 134 to accommodate recording media of the largest size 136 being printed by the printer. The extent of the cross-process travel distance for each applicator/blade combination can be seen in outline for the combination 104, 106 at outline 138 and for the combination 112, 114 at outline 140.

Figure 4:
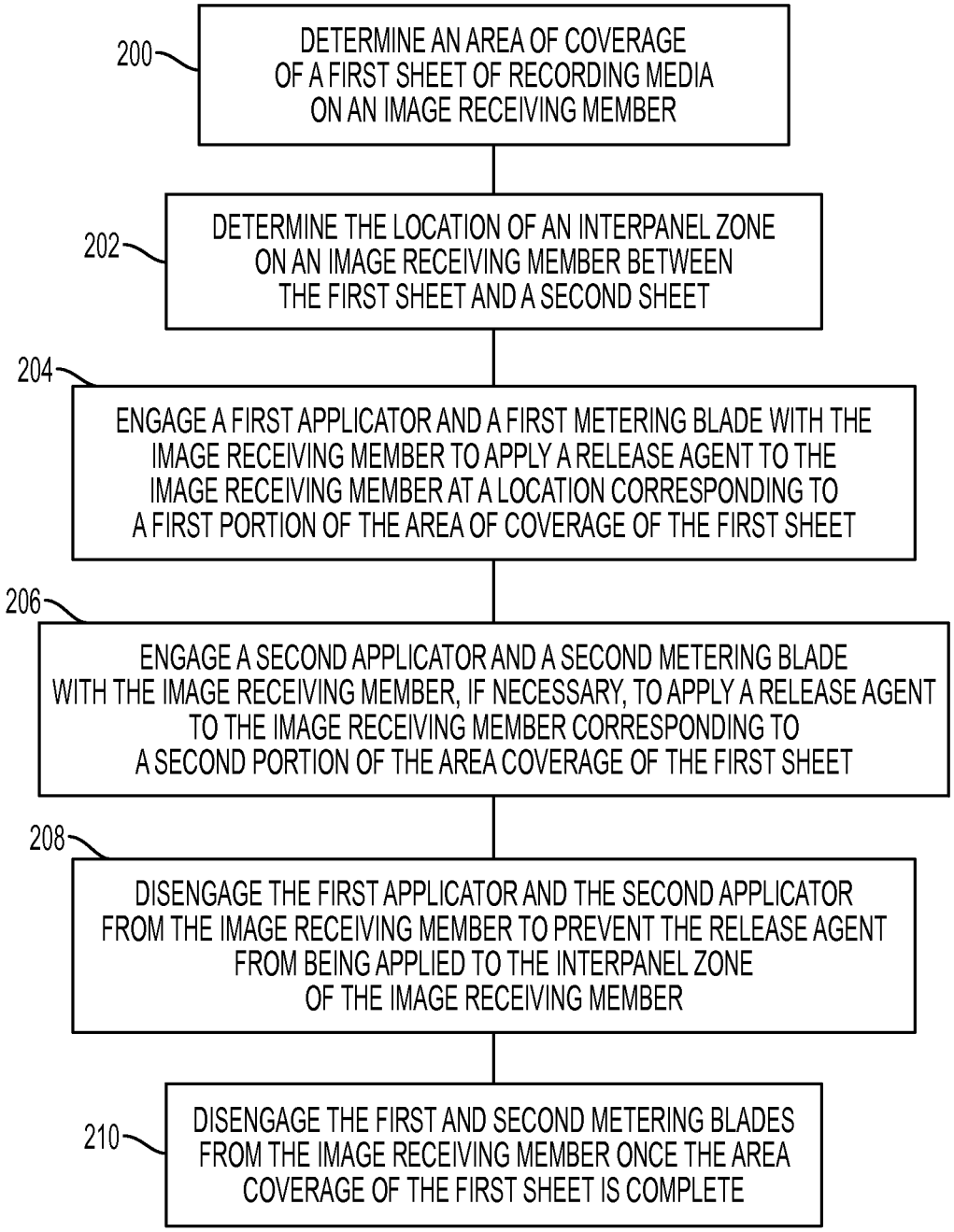
FIG. 4 is flow diagram of a method for controlling the application of a release agent to a surface of an image receiving member.

FIG. 4 illustrates one example of a method used to apply the release agent to an image receiving member of an inkjet printer. The flow diagram of FIG. 4 describes a method applicable to the embodiments described herein, as well as to other embodiments incorporating the teachings described herein. As illustrated in FIG. 4 at step 200, the area coverage of a first sheet of recording media on an image receiving member is determined by the controller 124. The area coverage, also known as an "image panel area", is based on the type of recording media being transported through the printer during a current print cycle. The controller 124 is configured with data identifying the type of recording media, including the length and width of a sheet corresponding to the process and cross-process dimensions of the recording media, to enable the controller to determine the area coverage.

Because sheets of recording media are printed sequentially, a space 142 between adjacent sheets 49, (the interpanel zone) is determined. (See FIG. 2). The controller, which controls the timing of the placement of the sheets of recording media upon the drum 14, uses the timing information, the rotational speed of the drum, and the size of the sheets to determine the size and location of the interpanel zone between a first sheet and a second or subsequent sheet (block 202). The interpanel zone can be defined as the distance between a trailing edge of the first sheet and the leading edge of the second sheet.

Once the location of the interpanel zone has been determined, the first applicator and first metering blade are engaged to the surface of the image receiving member (block 204). Upon engagement, the first applicator applies a release agent to the image receiving member at a location corresponding to a first portion of the area coverage of the first sheet. The first portion can correspond to the cross process width of the applicator and the process length of the first sheet. Engagement with the surface of the image receiving member can include positioning of a first applicator and first metering blade along the cross-process direction as described above and subsequent engagement to the surface of the drum. In addition, the first portion can include an entire portion of the recording media, if the smallest size of recording media is being processed.

Once movement of blade 104 and applicator 106 towards the surface 100 has started or simultaneously therewith, the second applicator and the second metering blade are engaged with the surface of the image receiving member, if necessary (block 206). The release agent is applied to a second portion of the image receiving member corresponding to a second portion of the area coverage of the first sheet. This application of release agent is not necessary if release agent sufficient to correspond to the entire sheet has been applied (block 204). As before, engagement of the applicator and blade can include positioning of the second applicator and second metering blade in the cross-process direction prior to engagement with the surface of the drum.

Once it has been determined that a sufficient amount of release agent has been deposited on the image receiving member to cover the image panel area of the first sheet, the first applicator and the second applicator can be disengaged from the surface of the image receiving member (block 208) to prevent release agent from being applied to the interpanel zone. The disengagement can occur substantially at the trailing edge of the first sheet or disengagement can occur before the anticipated location of the trailing edge. If the disengagement occurs at the trailing edge, the associated metering blades are also disengaged at substantially the same time as disengagement of the applicator.

In some embodiments, however, the applicator can be disengaged prior to the anticipated location of the trailing edge and the metering blade can remain engaged to move the applied release agent to the trailing edge of the image panel area. This sequence can be provided in order to mitigate timing issues related to a possibility of an oil bar or an oil line being left on the surface of the drum where the oil applicator is disengaged. If a possibility exists that the oil applicator can leave a residual amount of oil upon disengagement, disengagement of the applicator prior to the end of the image panel should be made. The metering blade, however, can remain engaged to enable the metering blade to wipe the oil bar toward the trailing edge of the image panel area. By disengaging the release agent applicator and leaving the blade engaged, the blade moves and smoothes out the oil line to minimize any of the oil bar left behind. By disengaging both applicator and blade substantially simultaneously or at different times, the space between a first sheet and a subsequent sheet of recording media can be substantially free of the release agent to thereby improve the print quality.

Additionally, each set of applicator/blade combinations can be independently engaged and disengaged with the drum 14. By using timing signals known to the system controller, each set can be disengaged for the interpanel zone between recording media. The mechanism or actuator for engaging/disengaging can be tailored to the specific implementation, and can include known technologies such as cam/followers, lead screws, rack and pinions, and stepper motors.

Consequently, the described embodiments can substantially reduce or eliminate image quality defects due to backside oil appearing on a second side of a sheet or recording media, which can be problematic in the case of duplex printing. By use of the teachings described herein, release agent can be applied to only those areas of the drum that will contact the media. This prevents release agent from migrating to the transfix roll, and subsequently to the back side of the media which affects the quality of images printed there during duplex printing. Also, substantially, no release agent is transferred to the pressure roll in the interpanel zone. Likewise, substantially no release agent is transferred to the pressure roll for print jobs using mixed cross-process paper sizes. The present embodiments also substantially eliminate the need for a release agent cleaning system thereby reducing or eliminating the need for running blank sheets of recording media through the printer to remove release agent contamination from unwanted locations.

It will be appreciated that several of the above-disclosed and other features, and functions, or alternatives thereof, can be desirably combined into many other different systems or applications. For instance, the embodiments described herein can be applied to a spreader in a direct marking system. Various presently unforeseen or unanticipated alternatives, modifications, variations, or improvements therein can be subsequently made by those skilled in the art, which are also intended to be encompassed by the following claims.

What is claimed is:

1. A printer to form an ink image on recording media of different sizes ranging from a first size to a second size larger than the first size comprising:

an image receiving member including a surface;

a printhead disposed adjacent to the image receiving member to form an ink image on the surface;

a first release agent applicator, disposed adjacent to the image receiving member, the first release agent applicator configured to deposit a release agent at a first area on the surface of the image receiving member;

a second release agent applicator, disposed adjacent to the image receiving member, the second release agent applicator configured to deposit a release agent at a second area on the surface of the image receiving member, at least a portion of the second area not being within the first area; and an actuator operatively connected to the first release agent applicator, the actuator being configured to translate the first release agent applicator in a cross-process direction across the image receiving member to alter a width of the first area onto which the first release agent applicator applies release agent.

2. The printer of claim 1 further comprising:

another actuator operatively connected to the second release agent applicator, the other actuator being configured to translate the second release agent applicator in a cross-process direction across the image receiving member to alter a width of the second area onto which the second release agent applicator applies release agent.

3. The printer of claim 2 wherein the image receiving member includes a rotating drum rotating about an axis having a width disposed in the cross-process direction, and media is carried by the drum in a process direction corresponding to a direction of rotation for the drum about the axis.

4. The printer of claim 3 wherein:

the first release agent applicator has a width in the cross-process direction;

the second release agent applicator has a width in the cross-process direction; and one end of the first release agent applicator and one end of the second release applicator overlap in the cross-process direction.

5. The printer of claim 1 wherein a width of one of the first release agent applicator and the second release applicator is substantially equal to a width of a sheet of recording media in the cross-process direction.

6. The printer of claim 3 wherein the first release agent applicator and the second release agent applicator each have a substantially equal width in the cross-process direction.

7. The printer of claim 1 further comprising:

a positioning mechanism operatively connected to the first release agent applicator, the positioning mechanism being configured to move the first release agent applicator into and out of engagement with the surface of the image receiving member.

8. The printer of claim 7, the positioning mechanism further comprising:

another actuator operatively coupled to the second release agent applicator, the actuator and the other actuator being configured to move the first release agent applicator and the second release agent applicator independently of one another and into and out of engagement with the surface of the image receiving member.

9. The printer of claim 7, the actuator further comprising:

at least one stepper motor.

* * * * *